US005931370A

United States Patent [19]

Poloni et al.

[11] Patent Number: 5,931,370

[45] Date of Patent: Aug. 3, 1999

[54] METHOD TO WELD BILLETS LEAVING A FURNACE AND A ROLLING LINE ADOPTING THE METHOD

[75] Inventors: Alfredo Poloni, Fogliano Di Redipuglia; Mirco Marchiori, Pordenone; Milorad Pavlicevic; Nuredin Kapaj, both of Udine, all of Italy

[73] Assignee: Danieli & C. Officine Meccaniche SpA, Buttrio, Italy

[21] Appl. No.: 08/932,583

[22] Filed: Sep. 17, 1997

[30] Foreign Application Priority Data

Sep. 25, 1996 [IT] Italy ..... UD96A0178

[51] Int. Cl.[6] ..... B21B 1/24; B23K 37/00

[52] U.S. Cl. ..... 228/158; 228/160; 228/171; 228/205; 228/5.7

[58] Field of Search ..... 228/5.7, 158, 171, 228/160, 205

[56] References Cited

U.S. PATENT DOCUMENTS

| | | | |
|---|---|---|---|
| 2,214,618 | 9/1940 | Kenyon et al. | 228/158 |
| 4,294,394 | 10/1981 | Iida et al. | 228/158 |
| 5,219,114 | 6/1993 | Kajiwara et al. | 228/5.7 |

FOREIGN PATENT DOCUMENTS

| | | | |
|---|---|---|---|
| 49 2368 A2 | 7/1992 | European Pat. Off. | 228/158 |
| 586823 | 3/1994 | European Pat. Off. . | |
| 761330 | 3/1997 | European Pat. Off. . | |
| 1120868 | 7/1956 | France . | |
| 1125304 | 10/1956 | France . | |
| 1095426 | 12/1960 | Germany . | |
| 2836338 | 2/1980 | Germany . | |
| 3824698 A1 | 2/1989 | Germany | 228/158 |

OTHER PUBLICATIONS

Stahl & Eisen, vol. 78, No. 16, Aug. 7, 1958, Dusseldorf DE pp. 1130–1132, "Das Auswalzen endlos zusammengeschweisster".

Patent Abstracts of Japan vol. 16, No. 467 (M–1317) Sep. 29, 1992, & JP–04 167902 (Hitachi) Jun. 16, 1992 abstract.

Patent Abstracts of Japan vol. 4, No. 161 (M–40) Nov. 11, 1980 & JP 55 112104 A (Nippon Steel) Aug. 29, 1980 abstract.

Patent Abstracts of Japan, vol. 6, No. 236 (M–173) Nov. 25, 1982 & JP 57 137008 A (Kawasaki) Aug. 24, 1982—abstract.

Patent abstracts of Japan, vol. 18 No. 663 (M–1723) Dec. 14, 1994 & JP 06 262244 (Kawasaki) Sep. 20, 1994 abstract.

Patent Abstracts of Japan vol. 16, No. 380 (M–1295) Aug. 14, 1992 & JP 04 123804 (Hitachi) Apr. 23, 1992 abstract.

Patent Abstracts of Japan vol. 11, No. 392 (M–653) Dec. 22, 1987 & JP 62 157715 (Sumitomo) Jul. 13, 1987 Abstract.

Patent Abstracts of Japan, vol. 9 No. 286 (M_429) Nov. 13, 1985 & JP 60 127006 A (Sumitomo) Jul. 6, 1985 abstract.

*Primary Examiner*—Samuel M. Heinrich
*Assistant Examiner*—Jeffrey T. Knapp
*Attorney, Agent, or Firm*—Antonelli, Terry, Stout & Kraus, LLP

[57] ABSTRACT

Method is for welding billets leaving a heating furnace in a rolling line, the line including, in the segment (10) between the heating furnace (11) and the first rolling stand, at least a drawing unit (14), a rollerway to transport the billets, a movable welding assembly (20) with welding jaws (31) and an emergency shears (13). The trailing end of the billet (12*a*) being rolled is welded to the leading end of the billet (12*b*) unloaded afterwards from the furnace (11) while the billets (12) are in movement by a welding assembly (20) mounted on a movable trolley (19). The movable trolley (19) is taken substantially to the rolling speed, grips the billets (12) with the jaws (31) of the welding unit (20) and welds the ends of the billets (12). The welding step is preceded by a descaling step carried out by a descaling unit (16) wherein the front faces of the billets (12) and at least those areas of the billets (12) cooperating with the jaws (31) are descaled and by a parallel plane cropping step of the trailing end and leading end of the billets (12) carried out by a cropping unit (29) mounted on the movable trolley (19) immediately upstream of the welding assembly (20). The welding step is followed by a step to remove the flashes carried out by a flash removal unit (38) while the billet (12) is in movement.

23 Claims, 4 Drawing Sheets

METHOD TO WELD BILLETS LEAVING A FURNACE AND A ROLLING LINE ADOPTING THE METHOD

This invention concerns a method to weld billets leaving a heating furnace, and also the rolling line which adopts this method, as set forth in the respective main claims.

The invention is applied particularly, but not only, in the rolling of billets where it is desired to obtain a substantially continuous feed, whether it be a completely hot load or also a mixed hot and cold load, from the heating furnace to the rolling train.

In rolling processes for billets where the rolling train is located in line with the continuous casting machine, the state of the art covers the need to ensure a high productivity of the plant but without causing a reduction in the surface quality and the inner quality of the final product.

It is also necessary to make the work times of the rolling train compatible with the casting times, in order to prevent a discontinuous functioning of the rolling stands with all the problems connected to the correct use of the rolling rolls and their activation.

In the art of rolling mills, systems have been proposed which teach to weld the trailing end of the billet which is already being rolled, with the leading end of the next billet arriving from the casting machine, or fed from buffer stores associated with the line, in order to ensure a substantially continuous feed to the rolling train.

U.S. Pat. No. 2,214,618 provides to weld the leading end of a strip with the trailing end of the strip being worked, while stationary.

In order to do this, it is necessary to slow down the cycle or use buffer stores which can be included only when plate or wide plate is being worked.

These buffer store systems are not only complicated and complex, but they must also work at temperature and require considerable vertical space.

In addition, these systems cannot be adopted in the case of billets, so that the stationary welding machine would block the rolling cycle downstream, causing a loss of productivity, marking of the product, problems in restarting, etc.

DE-A-2.836.338 indicates generally a welding process with a movable welding system which follows the billet.

The indications are very generic and do not give any information about how the leading end billet and trailing end billet are treated, or how the welding machine functions.

However, the welding systems known to the state of the art have shown they have great problems, both in operation and in technology, which until now have prevented this technique from being used reliably on a larger scale of products and processes, without altering the productivity of the line and/or the quality of the final product.

One of the main problems is that if the surfaces of the two ends which are to be welded are not exactly plane and parallel, the welding is imprecise, it takes longer to carry out and the final result is not satisfactory.

Moreover, the presence of a large quantity of scale on the billets as they leave the furnace impedes the welding, makes it difficult and unreliable, as the scale impedes the correct passage of the current on the gripping jaws which carry out the welding.

A further problem is that, once the welding has been carried out, the surface area which has been welded has a temperature which is not uniform with respect to the core of the billet, and this creates problems in the initial squeezing step carried out by the rolling rolls and a consequent poorer quality of the product.

It is also a problem to remove the flashes caused by flash pressure welding.

A further problem is the need to include a system to intervene rapidly to separate the billet which has been rolled from the billet to be rolled when there is a blockage in the rolling train.

Another problem is the unequal geometry of the leading end of one billet compared with the trailing end of the preceding billet.

The present applicants have designed, tested and embodied this invention to overcome these shortcomings of the state of the art and to achieve further advantages.

This invention is set forth and characterised in the respective main claims, while the dependent claims describe variants of the idea of the main embodiment.

The main purpose of the invention is to provide a method to weld billets leaving a heating furnace which will overcome the above-mentioned problems, and make it possible to use this welding reliably and efficiently so as to obtain a continuous feed to the rolling train.

Another purpose of the invention is to provide a rolling line which, by adopting the welding method as above, will make it possible to optimise productivity without reducing in any way the surface quality and the outer quality of the final product.

The welding method according to the invention is applied to billets leaving a heating furnace inside which the billets produced by one or more continuous casting machines, or cold billets taken from buffer stores, or a mixture of hot and cold billets, are progressively accumulated.

According to the invention, the welding machine at the outlet of the heating furnace is placed on a movable trolley and moves, in a coordinated manner with the billet being rolled, to carry out the welding as the billet moves.

At the outlet of the heating furnace and upstream of the movable trolley there is a first descaling unit attached to the ground.

In one embodiment of the invention, this first descaling device has rotary nozzles; according to a variant the first descaling device is of the mixed type, with both stationary and rotary nozzles.

The stationary nozzles are used to descale the leading ends of the billets while the rotary nozzles are used to descale the area of contact with the welding jaws or, according to a further variant, for the whole length of the billet.

According to the invention, the jaws of the welding machine centre the billets on a geometric axis of the section in such a way that the billets are centred correctly even when the billets do not have homogenous sections.

According to a variant of the invention, on the movable trolley which carries the welding machine, and upstream of it, there is a second descaling unit which cleans the surface of the billets which are to be welded and particularly the area where the billets are joined.

In one formulation of the invention this second descaling unit is of the rotary kind.

The combination of a rotary descaling device placed immediately upstream of the welding machine, together with the fact that the second descaling device moves with the machine and follows its movement, causes an extremely efficient action of removal of the scale; what is more, the scale does not have time to re-form before welding takes place.

The complete absence of scale on the surface of the billets being welded facilitates the passage of the current between the welding jaws and thus improves and accelerates the start of the welding cycle.

According to a variant of the invention, at least the second descaler can be automatically adjusted with regard to descaling times, water flow and/or pressure according to the type of scale to be removed and/or the type of product being rolled.

According to the invention, between the second descaler and the welding machine, on the movable trolley, there is at least a cropping unit to crop the leading and trailing ends of the billets to be coupled.

This cropping unit arranges the two surfaces in such a way that, apart from being without scale, they are also perfectly plane and parallel to each other, which considerably improves the efficiency of the welding.

In one embodiment of the invention, the cropping unit is composed of a cropping machine with at least one rotary blade.

According to a variant, the cropping machine has two rotary blades installed on a single blade-bearing mandrel, and the blades crop the leading end of one billet and the trailing end of the other billet at one and the same time.

According to one embodiment of the invention, on the welding trolley there is a unit to remove the welding flashes.

According to the invention, the transport way for the billets leaving the furnace is of the type with one channel and is composed of successive rollers mounted on pivoting supports.

During the welding cycle these pivoting supports are bent by the advance of the movable trolley carrying the welding machine and rise again after the passage of the movable trolley to act as a support for the billet again.

Downstream of the pivoting rollerway there is an emergency drawing unit which is used to send back the billet which still has to be rolled, in the event of a blockage in the rolling train.

This emergency drawing unit cooperates with an emergency shears located downstream of the drawing unit which is able to separate the rolled billet from the billet which still has to be rolled.

According to the invention, in a position adjacent to the rollerway and outside the line, there is a storage surface onto which billets present on the rollerway can be unloaded in the event of a blockage in the rolling train.

According to a variant of the invention, at the outlet of the pivoting rollerway and downstream from the end-of-travel of the movable trolley of the welding machine, there is a heating system able to make the temperature uniform, particularly of the edges and/or the area where the billets are joined.

This heating system, according to one embodiment, is of the induction type.

According to a variant, the heating system is configured as a tunnel furnace with heating means.

According to a further variant, the heating system is of the flash type.

In cooperation with the heating system there are also containing elements with bottoms which can be opened so as to unload and remove the scale and waste which are produced during the passage and the heating of the billets.

The attached figures are given as a non-restrictive example, and show a preferred solution of the invention as follows.

Figure 1:
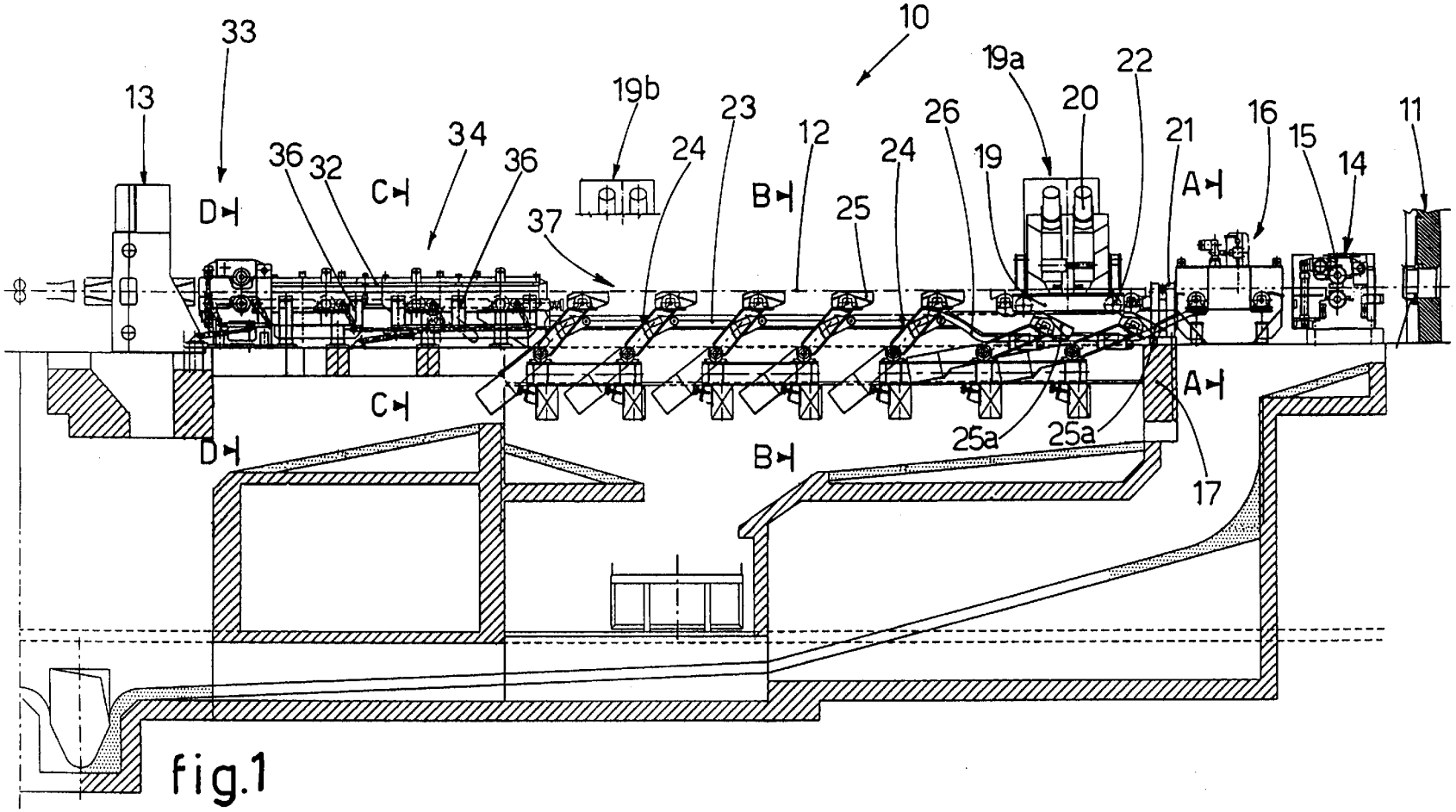
FIG. 1 shows a longitudinal section of one segment of the rolling line which adopts the welding method according to the invention.
Figure 5:
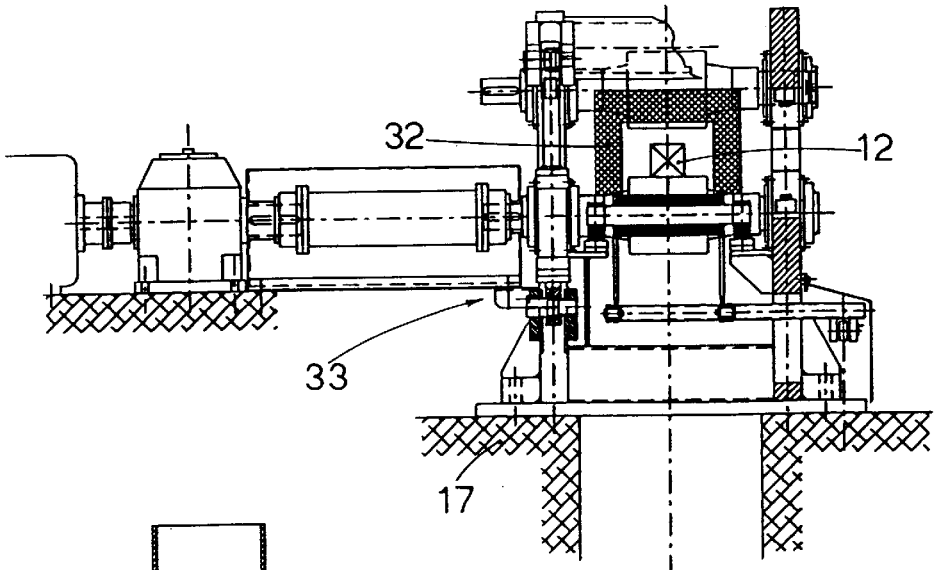
FIG. 5 shows the section from D to D of FIG. 1.
Figure 2:
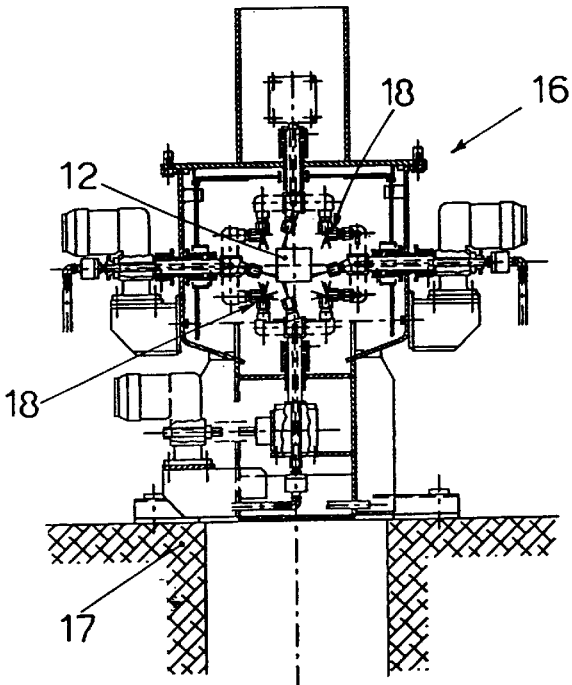
FIG. 2 shows the section from A to A of FIG. 1.
Figure 4:
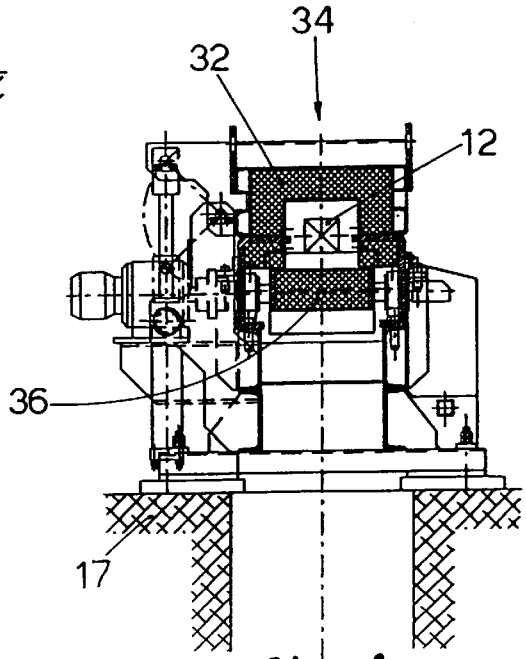
FIG. 4 shows the section from C to C of FIG. 1.
Figure 6:
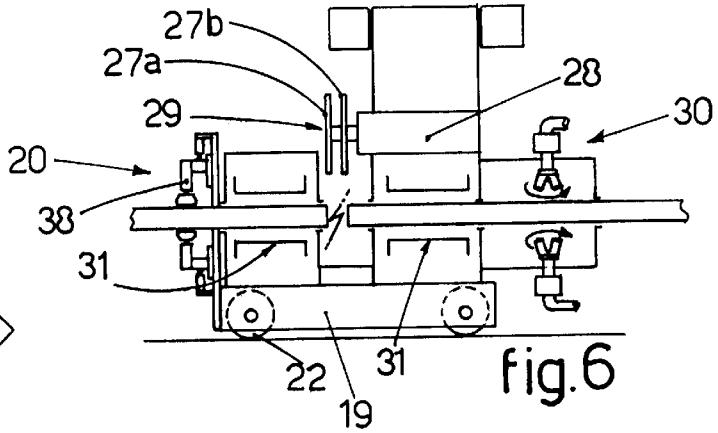
FIG. 6 shows a detail of the movable trolley carrying the welding machine shown in FIG. 1.
Figure 3:
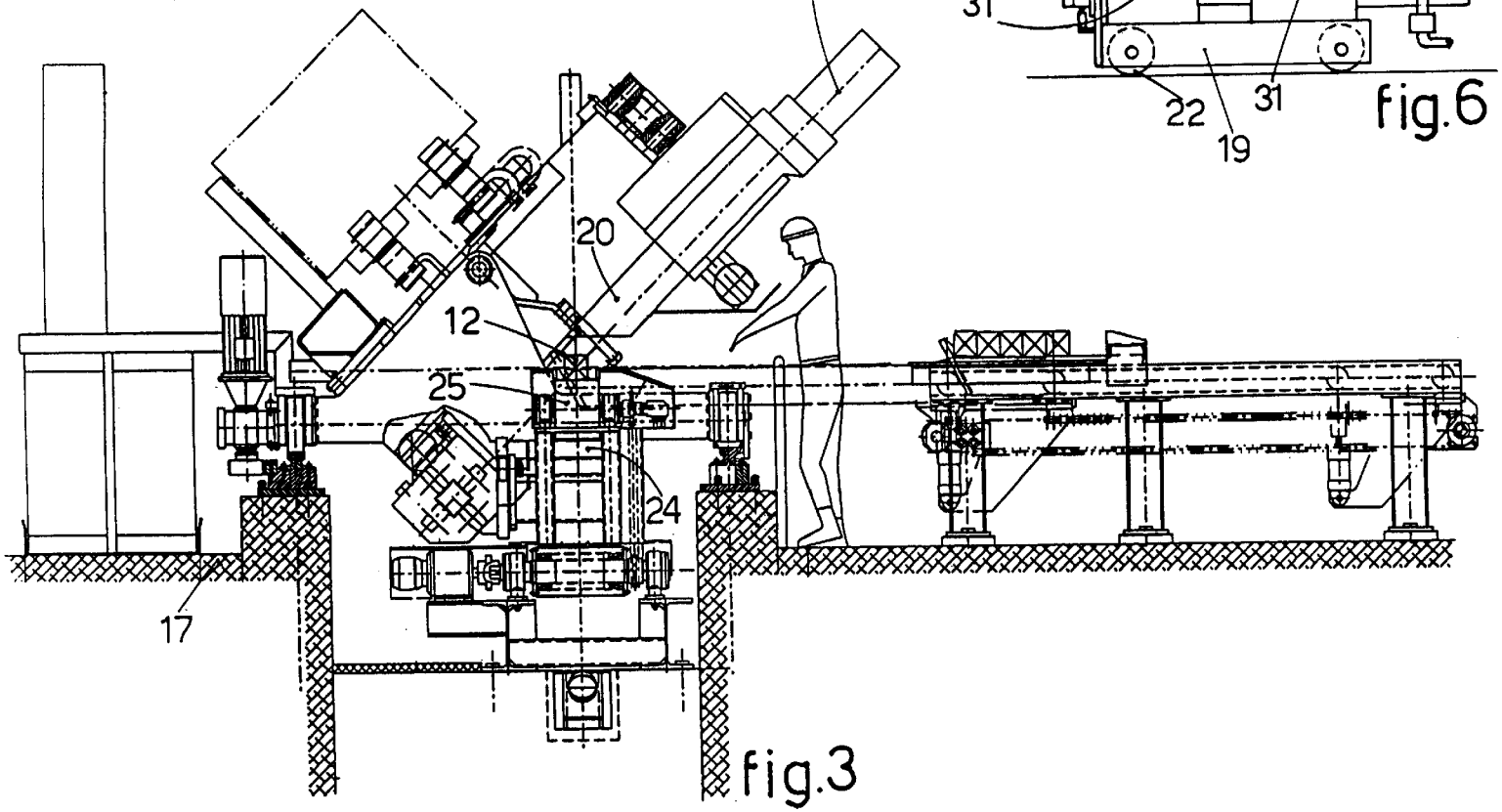
FIG. 3 shows the section from B to B of FIG. 1.

In FIG. 1, the number 10 denotes generally the segment of a rolling line placed between a heating furnace 11, which is only partly shown here, for billets 12 and an emergency pendulum shears 13 placed before the inlet to the rolling train, which is not shown here, served by a drawing unit 33.

The heating furnace 11 is of the type arranged to accumulate billets 12 from several casting lines and/or to mix feed the hot/cold billets 12; it cooperates upstream with transport and feeding means of a type known to the state of the art.

According to a variant not shown here, for products which do not need particularly high standards of quality, the furnace 11 cooperates upstream with cropping means to crop the leading and trailing ends of the billets 12 which are to be sent for welding.

In this case the cropping is carried out cold, for example with disk-type rotary saws to cut the billets 12 of various lengths.

At the outlet of the heating furnace 11 there is a drawing unit 14 with pinch rolls 15.

This drawing unit 14 serves to move the billet 12 as it leaves the furnace at a variable speed according to need. Downstream of the drawing unit 14 there is a first descaling device 16 of the mixed type, attached to the foundation surface 17, with nozzles 18 both of the stationary type and the rotary type.

In particular, in this case, the nozzles 18 of the stationary type serve to remove the scale from the surface of the billets 12 in correspondence with the leading ends, while the nozzles 18 of the rotary type serve to remove the scale at least from the area of the billets which, in the following stage, will be the area of contact with the welding jaws 31.

If necessary, the nozzles 18 of the rotary type carry out the descaling over the whole length of the billet 12.

Downstream of the first descaler 16 there is the movable trolley 19 on which is mounted the welding assembly 20.

In this case, between the first descaler 16 and the movable trolley 19 there is a retractable clamping device 21 which clamps the billet 12 in the event that there is a blockage downstream.

The movable trolley 19 has wheels 22 and moves with an alternate motion on runways 23, such as rails, guides or similar, according to the advance of the billets 12 to be coupled.

The advance of the movable trolley 19 causes the lowering of the pivoting supports 24 on which are mounted the rollers 25 which constitute the motorised rollerway 37 which supports and feeds the billets 12.

This lowering is achieved by a fork-type element 26, solid during the advance of the movable trolley 19, in such a way that the supports 24 with the relative rollers 25 are lowered below the movable trolley 19 during the advance of the latter (see rollers 25*a*), and rise again, thanks to a lifting system or counterweight, once the movable trolley 19 has passed them by, so as to support the advancing billets 12 again.

The complete retraction of the roller 25 below the movable trolley 19 is achieved by the very low position of the centre of rotation of the relative pivoting support 24.

In this case, on the movable trolley 19 and upstream of the welding assembly 20 there is a cropping device 29 with a double rotary blade, respectively 27*a* front and 27*b* rear, which are used to crop the rear or trailing end of the billet 12 placed in front, and the front or leading end of the billet 12 placed behind.

The two blades 27*a* and 27*b* are mounted, in this case, on a single mandrel 28 to reduce as much as possible the cutting times and are arranged, in this case, to crop the ends according to a desired length.

In this case, the blade-bearing mandrel 28 is supported by a movable support moved by a hydraulic cylinder which has a controlled speed.

The rotation of the blades 27*a* and 27*b* is achieved by means of an electric motor possibly incorporating mechanical transmission.

The pitch between the two blades 27*a* and 27*b* is, in this case, between about 30 and about 70 mm, advantageously between 40 and 50 mm.

The cropping machine 29 serves to arrange perfectly plane and parallel surfaces for the welding, so that the welding process gives a perfect coupling and therefore a perfect join.

In the event that cropping is carried out upstream of the furnace 11, the cracks and bubbles can oxydise during the pre-heating step, which creates problems with the products and reduces the final quality of the rolled stock.

In this case, on the movable trolley 19 is mounted a second descaler 30 of the rotary type, which has the function of completing the descaling action carried out by the first descaler 16 and in particular of cleaning in the best possible way the part of the surface of the billets 12 which will later find itself in contact with the jaws 31 of the welding assembly 20.

The cleaning of this contact area ensures the optimum passage of the current from the welding jaws 31 and therefore an efficient and rapid start to and completion of the welding cycle.

In this case, the second descaler 30 has adjustable working parameters, both as regards the descaling times and as regards the water flow and/or pressure.

Downstream of the welding assembly 20 on the trolley 19 itself there is a unit to remove the flashes 38 which serves to eliminate the welding flashes.

Moreover, the jaws 31 centre the billet 12 on the ideal centering axis 39 of the section of the billet 12 itself, so that this compensates for any geometric differences in section between the two billets 12 to be coupled.

With respect to the welding cycle, the forward movement of the movable trolley 19 is correlated to the advance of the billets 12 from an initial position 19*a* to an end-of-travel position identified diagrammatically by 19*b*.

The continuous billet 12 leaving the movable trolley 19 is introduced inside a maintenance system 34 comprising at least a movable cope 32, associated at the outlet with a drawing unit 33 arranged upstream of the emergency shears 13.

According to a variant, the maintenance system 34 is associated with a heating system, for example by means of burners, in order to render the temperature of the billets 12 uniform, particularly the edges of the billet 12.

According to another solution, the heating system comprises an induction furnace.

This maintenance and possibly heating system 34 comprises at the lower part doors 36 which can be opened to unload and discharge the waste and scale which form on the surface of the billet 12.

The emergency shears 13 and the drawing unit 33 intervene in the event of a blockage in the rolling train, the first to separate the billet 12 which has already been rolled from the one which still has to be rolled, and the second to take the latter billet 12 back on the rollerway 37.

The stationary billet is then transferred if necessary, by means of extendable mechanical hands, onto a storage surface 35 located off line at the side of the rollerway 37.

Figure 7:
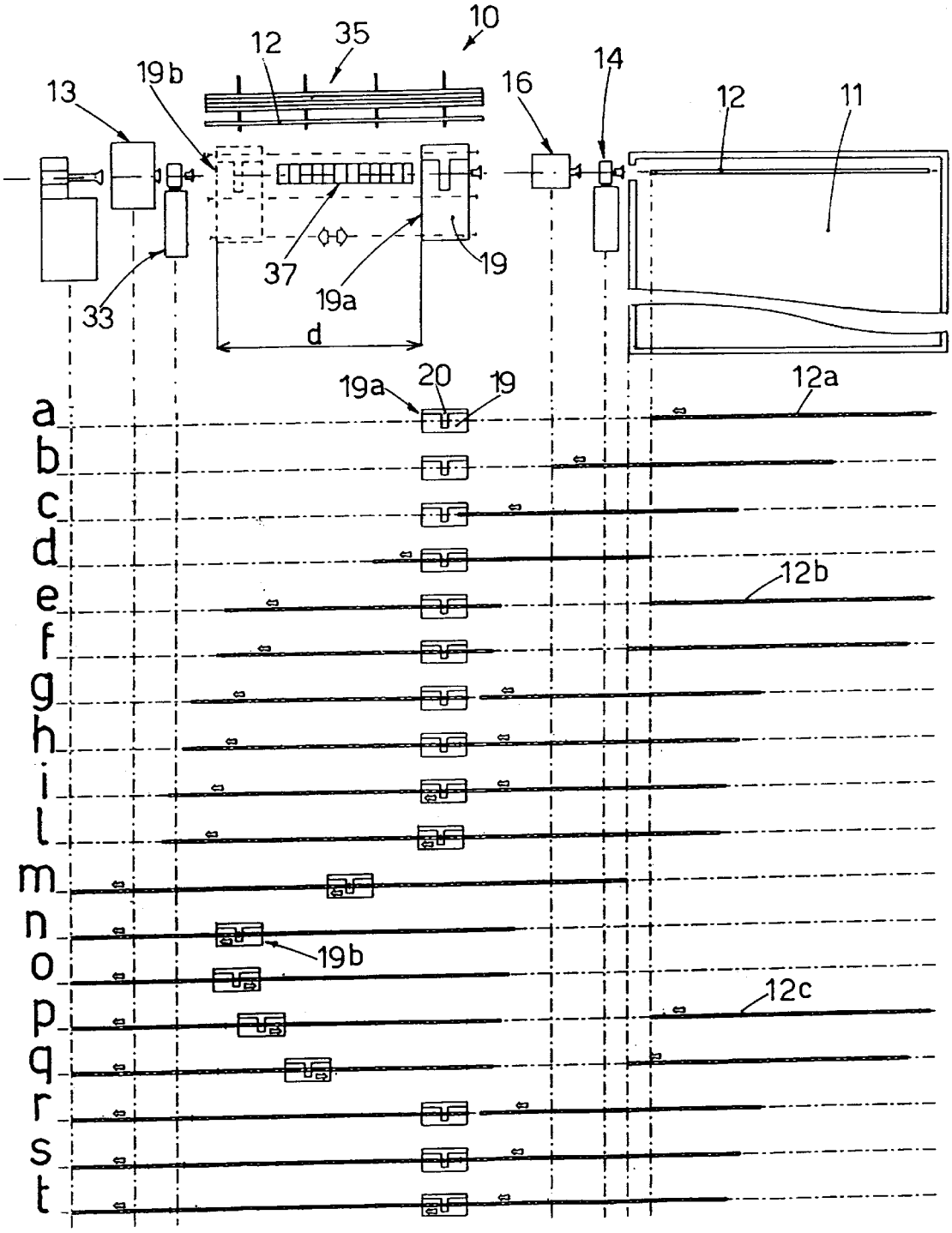
FIG. 7 shows the welding cycle used in the method according to the invention.

FIG. 7 shows the various steps of the welding method according to the invention. In FIGS. 7*a*, 7*b*, 7*c*, and 7*d* the billet 12*a* is progressively unloaded from the furnace 11 until the leading end cooperates with the movable trolley 19 which carries the welding assembly.

The billet 12*a* is then slowed down until it reaches substantially the rolling speed and then (FIGS. 7*e*, 7*f*) the billet 12*b* is unloaded from the furnace 11.

The billet 12*b*, with a much higher outlet speed than that of the billet 12*a*, rapidly approaches the billet 12*a* (FIG. 7*g*) until the respective ends are in contact (FIG. 7*h*) inside the movable trolley 19.

At this point, the movable trolley 19 is activated until it reaches substantially the rolling speed (FIGS. 7*i*, 7*l*).

In that part of the travel of the movable trolley 19 which is indicated by the letter 'b', between the position shown in FIG. 7*l* and that in FIG. 7*n*, the leading end and trailing end of the billets 12*a* and 12*b* are cropped, and welded by means of the welding jaws 31.

Once welding has been completed, and the end-of-travel position reached, the movable trolley 19 stops, and begins its return journey in the opposite direction until it repositions itself in its starting position (FIGS. 7*o*, 7*p*, 7*q*, and 7*r*).

During the return journey of the movable trolley 19, the billet 12*c* begins to be unloaded from the heating furnace 11 at a speed which is much higher than the speed at which the billets 12*a* and 12*b*, joined together, are advancing, until, substantially at the same time that the movable trolley 19 reaches its original starting position, the leading end of the billet 12*c* comes into contact with the trailing end of the billet 12*b* (FIG. 7*s*).

At this point the welding cycle as described above begins again (FIG. 7*t*).

We claim:

1. Rolling line for billets which adopts a moving welding method at the outlet of a heating furnace, the line comprising, in the segment (10) between the heating furnace (11) and the first rolling stand, at least a drawing unit (14), a rollerway to transport the billets, a movable welding assembly (20) including welding jaws (31) and an emergency shears (13), the line being characterised in that it comprises, downstream of the drawing unit (14), a first, stationary descaling unit (16), a movable trolley (19) with an alternating movement on its relative runways (23), the movable trolley (19) supporting at least a welding assembly (20) with jaws (31) to grip the billets (12), a cropping unit (29) and a movable descaling unit (30), the movable trolley (19) including a first position (19*a*) while it waits for the billets (12) which is immediately downstream of the first, stationary descaling unit (16) and a second, end-of-travel position (19*b*), a transport path (37) with rollers (25) mounted on pivoting supports (24) having a first working position and a second, retracted position, a temperature maintaining system (34) and, an emergency shears (13).

2. Rolling line as in claim 1, in which the first stationary descaling unit (16) includes nozzles (18) of the stationary type and nozzles (18) of the rotary type.

3. Rolling line as in claim 1, in which the welding jaws (31) are movable along the ideal centering axis (39) of the section of the billets (12).

4. Rolling line as in claim 1, in which there is a unit to remove the flashes (38) on the movable trolley (19).

5. Rolling line as in claim 1, in which upstream of the emergency shears (13) there is a drawing unit (33).

6. Rolling line as in claim 1, in which, in a position adjacent to the rollerway (37) and off line there is a storage surface (35) to temporarily accumulate the billets (12) in the event that there is a blockage in the rolling train.

7. Rolling line as in claim 1, in which the second retracted position of the pivoting supports (24) cooperates with the passage of the movable trolley (19).

8. Rolling line as in claim 7, in which the movable trolley (19) is associated at the front part with a fork element (26) cooperating with the pivoting supports (24) to take them from the first working position to the second retracted position and vice versa.

9. Rolling line as in claim 1, in which the temperature maintaining system (34) comprises further heating means and means to make uniform the temperature of the surface and core of the billet (12), particularly in the area of the join.

10. Rolling line as in claim 9, in which the heating system comprises a tunnel associated with heating burners.

11. Rolling line as in claim 9, in which the heating system comprises rapid heating means of the induction type.

12. Rolling line as in claim 9, in which the temperature maintaining system (34) is associated at the lower part with containing elements with a bottom (36) which can be opened to discharge and unload the waste and scale.

13. Method to weld billets leaving a heating furnace in a rolling line, the line comprising, in the segment (10) between the heating furnace (11) and the first rolling stand, at least a drawing unit (14), a rollerway to transport the billets, a movable welding assembly (20) with welding jaws (31) and an emergency shears (13), wherein the trailing end of the billet **(12*a*) being rolled is welded to the leading end of the billet (12*b*) unloaded afterwards from the furnace (11) while the billets (12) are in movement by a welding assembly (20) mounted on a movable trolley (19), the method being characterised in that the movable trolley (19) has a first, stationary condition while it waits for the position of contact between the ends of the billets (12) to be coupled, a second condition as it advances, where it is taken substantially to the rolling speed, grips the billets (12) with the jaws (31) of the welding unit (20) and welds the ends of the billets (12), and a third condition of retreat where the movable trolley (19) returns to its starting position, the welding step being preceded by a descaling step carried out by a descaling unit (16) wherein the front faces of the billets (12) and at least those areas of the billets (12) cooperating with the jaws (31) are descaled, and by a parallel plane cropping step of the trailing end and leading end of the billets (12) carried out by a cropping unit (29) equipped with at least one rotary blade (27) and mounted on the movable trolley (19) immediately upstream of the welding assembly (20), the welding step being followed by a step to remove the flashes carried out by a flash removal unit (38) while the billet (12)** is in movement.

14. Method as in claim 13, in which the billets (12) are centred in the jaws (31) of the welding assembly (20) along an ideal centering axis (39) of the section of the billets (12) themselves.

15. Method as in claim 1, in which the billet (12) is subjected to a second descaling step by a movable descaling unit (30) immediately upstream of the welding step.

16. Method as in claim 1, in which the cropping unit (29) comprises a system with a double rotary blade **(27*a*, 27*b*) associated with a single mandrel (28), the first blade (27*a*) arranged to crop the trailing end of the billet (12*a*) located further forward, the other blade (27*b*) arranged for the simultaneous and parallel cropping of the leading end of the billet (12*b*)** located behind.

17. Method as in claim 1, in which the cropping step of the relative ends of the billets (12) is preceded by a descaling step carried out while the billet is in movement by a second descaling unit (30) mounted on the movable trolley (19).

18. Method as in claim 17, in which the second descaler (30) is of the rotary type and acts specifically in correspondence with the area where the billets (12) are joined.

19. Method as in claim 17, in which the second descaler (30) has descaling times and/or parameters for the flow and/or pressure of water which can be adjusted.

20. Method as in claim 1, in which the welded billet (12), before entering the rolling mill, is subjected to an at least localised heating action.

21. Method as in claim 20, in which the heating action is obtained by an induction system.

22. Method as in claim 20, in which the heating is obtained with a flash system.

23. Method as in claim 20, in which the heating is obtained with a heating tunnel system.

* * * * *